US006729655B1

(12) United States Patent
Dorricott et al.

(10) Patent No.: US 6,729,655 B1
(45) Date of Patent: May 4, 2004

(54) SECURITY SHEET AND METHOD

(75) Inventors: William James Dorricott, Buckinghamshire (GB); Simon Derek Henwood Jarvis, Gloucestershire (GB)

(73) Assignee: De La Rue International Limited, Hampshire (GB)

( * ) Notice: Subject to any disclaimer, the term of this patent is extended or adjusted under 35 U.S.C. 154(b) by 0 days.

(21) Appl. No.: 09/914,202

(22) PCT Filed: Mar. 14, 2000

(86) PCT No.: PCT/GB00/00927

§ 371 (c)(1),
(2), (4) Date: Nov. 7, 2001

(87) PCT Pub. No.: WO00/56979

PCT Pub. Date: Sep. 28, 2000

(30) Foreign Application Priority Data

Mar. 19, 1999 (GB) ..... 9906452

(51) Int. Cl.[7] ..... B42D 15/00
(52) U.S. Cl. ..... 283/72; 283/113
(58) Field of Search ..... 283/72, 82, 83, 283/86, 91, 93, 94, 114, 113; 428/195

(56) References Cited

U.S. PATENT DOCUMENTS

| | | | | |
|---|---|---|---|---|
| 4,536,016 A | | 8/1985 | Solomon et al. | |
| 4,652,015 A | | 3/1987 | Crane | |
| 5,248,544 A | * | 9/1993 | Kaule | 428/195 |
| 5,275,870 A | | 1/1994 | Halope et al. | |
| 5,388,862 A | * | 2/1995 | Edwards | 283/82 |
| 5,492,370 A | | 2/1996 | Chatwin et al. | |
| 5,547,916 A | | 8/1996 | Morrison | |
| 5,660,919 A | | 8/1997 | Vallee et al. | |

FOREIGN PATENT DOCUMENTS

| | | |
|---|---|---|
| EP | 0 319 157 A2 | 6/1989 |
| EP | 0 839 670 A1 | 5/1998 |
| WO | WO 97/17493 | 5/1997 |
| WO | WO 97/34170 | 9/1997 |

* cited by examiner

*Primary Examiner*—Willmon Fridie, Jr.
(74) *Attorney, Agent, or Firm*—Oliff & Berridge, PLC

(57) ABSTRACT

A security sheet includes a viewable security feature on or in a substrate (1). A print receptive coating (3–5) is provided on the substrate, the coating being registered relative to the security feature (2, 10) so that it does not overlap the security feature.

23 Claims, 2 Drawing Sheets

SECURITY SHEET AND METHOD

This application is a divisional application of application Ser. No. 09/750,988, filed Dec. 28, 2000, now U.S. Pat. No. 6,530,192, which is hereby incorporated by reference.

BACKGROUND OF THE INVENTION

1. Field of the Invention

The invention relates to a security sheet such as a security paper and a method for manufacturing such a sheet.

2. Description of the Related Art

Security sheets such as security papers or films are used for manufacturing security documents such as banknotes, identity cards and the like. Conventionally, a wide variety of security features are incorporated into such security sheets or provided on their surface. Examples include watermarks, security threads and other banded security features. A problem with conventional security sheets is that it is often not possible to achieve high quality print on the sheet in view of the nature of the sheet material. It is also not possible to gain full potential from types of ink such as metallic/colour changing inks since these do not fully exhibit their optical characteristics due to absorption by the sheet material.

It is known in the case of certain papers to coat the paper so as to provide a better receptive surface for print but the problem with this approach is that the coating obscures the security features which have been incorporated in or onto the paper.

In accordance with one aspect of the present invention, a security sheet includes a viewable security feature on or in a substrate; and a print receptive coating on the substrate, the coating being registered relative to the security feature so that it does not overlap the security feature and so that the security feature is viewable from the same side of the substrate as the coating wherein the security feature is chosen from the group comprising watermarks, security threads and banded security features such as fibres or planchettes.

In accordance with a second aspect of the present invention, a method of manufacturing a security sheet comprises providing a substrate on or in which is provided a security feature; and providing a print receptive coating on the substrate in register with the security feature so that the coating does not overlap the security feature, and so that the security feature is viewable from the same side of the substrate as the coating wherein the security feature is chosen from the group comprising watermarks, security threads and banded security features such as fibres or planchettes, wherein the security feature is chosen from the group comprising watermarks, security threads and banded security features such as fibres or planchettes.

SUMMARY OF THE INVENTION

We have found that it is possible to partially coat the substrate with a print receptive coating so that the security feature is not obscured but much higher print quality can then be achieved by printing onto the coating. Additional security is also achieved since the presence of the coating will not immediately be obvious to the eye and by controlling the degree of registration, it will be possible to achieve high quality print features very close to the security features in a way which would be very difficult to counterfeit.

BRIEF DESCRIPTION OF THE DRAWINGS

It should be noted that although the invention is primarily described with reference to a single security feature, there may be a multiplicity of such security features, the coating being arranged so as not to overlap any or at least some of these security features. The security features themselves may comprise watermarks, security threads and banded security features such as fibres or planchettes which are either buried in the sheet or provided on the sheet. A particularly preferred security feature is the so-called "windowed thread" described in more detail in EP-A-0319157.

Particular advantages of the invention in connection with these security features are as follows:

Figure 1:
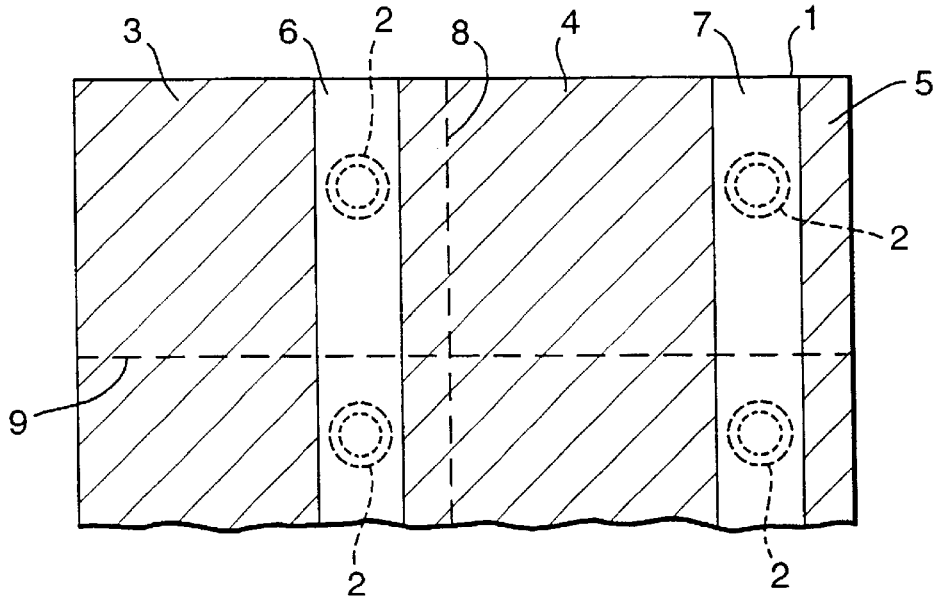

a) For a watermark, this means the coating does not flood the thin/low density areas of the watermark (which appear light when viewed in transmitted light) or increase the bulk on the thick/high density areas (which appear dark the bulk on the thick/high density areas (which appear dark when viewed in transmitted light)—furthermore coating areas adjacent to a watermark or window thread feature adds bulk to the non-watermarked area which protects the watermark during subsequent calendering operations—this allows a relatively high gloss to be achieved on the paper surface without significant damage or crushing of high quality multitonal watermark or window thread features.

b) For a thread (in particular a window thread), this means the coating does not cover (or further cover) the thread surface and this is of particular benefit where the surface of the thread carries a security feature such as microtext, thermally activated text, special thread coatings or colourants or holograms.

c) For other security features applied to the paper in the form of a linear strip (such as planchettes or security fibres), this means that the paper can be coated without any masking of the banded security feature.

Typically, the coating will be in the form of one or more stripes which may be continuous or discontinuous. Furthermore, the stripes could be rectilinear or have a wavy form.

Conveniently, the majority of the sheet is provided with the coating so that as much as possible of the sheet can carry enhanced quality print. In the preferred examples, edges of the coating extend to edges of the security feature.

The substrate can take any conventional form and may be single or multi-layer. Typical substrates comprise security papers or films such as plastic films.

The sheet can be manufactured in a variety of ways. In general, however, the coating is provided by passing the substrate under/over a coating roller; and selectively supplying coating materials to the roller whereby the coating is provided on the substrate in such a way as not to overlap the security feature.

In one case, the coating roller has a surface relief, for example being etched, grooved or engraved, to achieve a differential take-up of the coating material.

In another example, the coating roller is selectively provided with a hydrophilic coating in those areas corresponding to areas on the coating roller which are not to receive the coating material.

In a further example, one or more blocking members such as airknives or doctor blades are provided in association with the coating roller surface to clear an annular ring of coating from the surface as it rotates.

In yet a further example, a raised annular strip may be attached to the coating roller locally to hold the substrate clear of the coating roller surface.

A further enhancement of security can be achieved by coating the substrate in an intermittent or pulsed manner so as to produce one or more discontinuous coating strips. This also enables matching to security features in/on the substrate. This also allows strips to be provided which extend transverse to the substrate feed direction.

In a further enhancement, the coating may be provided in a non-rectilinear form, for example by oscillating the coat-free stripe(s).

Following preparation of the security sheet, this can be printed in any conventional manner, for example with further security print features as are well known in the art. In a particularly preferred approach, this further printing extends across the edge of the coating so as to disguise the presence of a coating still further.

Figure 2A:
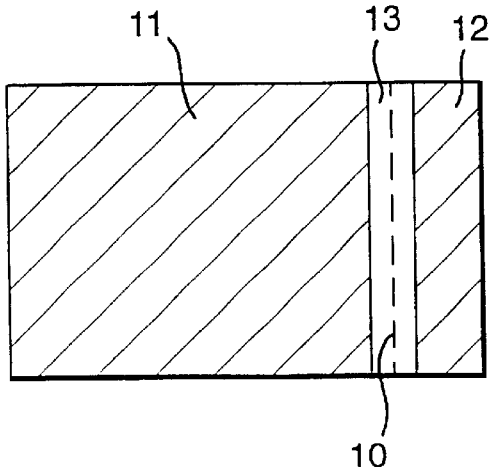
Figure 2B:
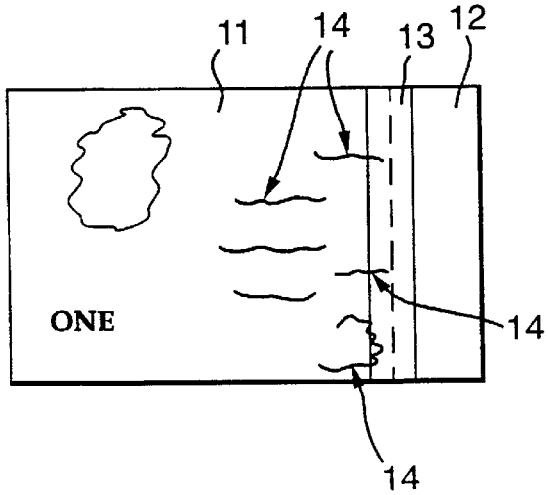
Figure 3:
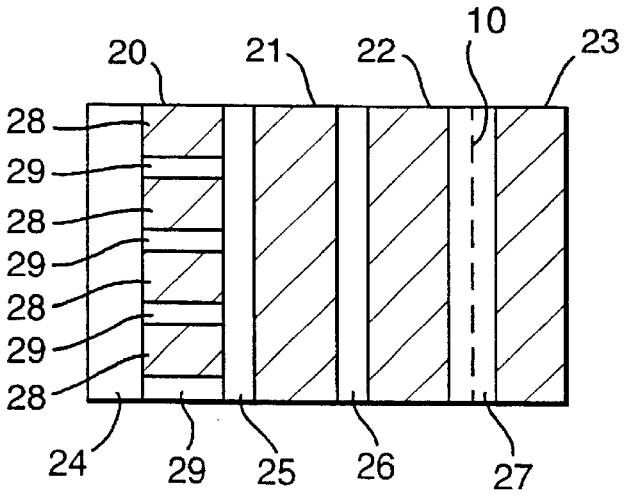
Figure 4:
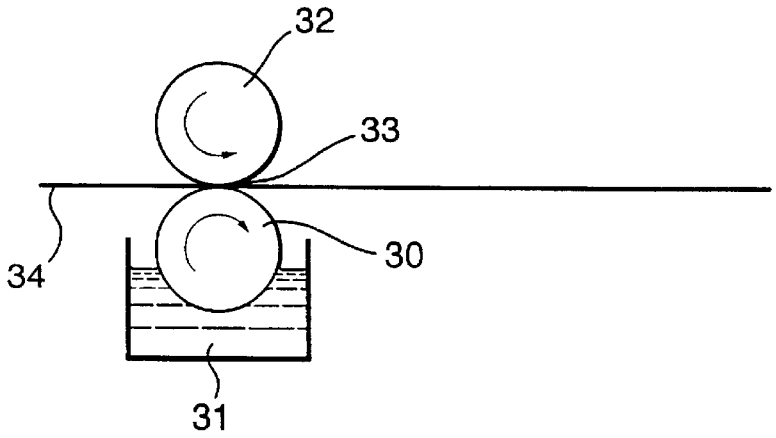
Figure 5:
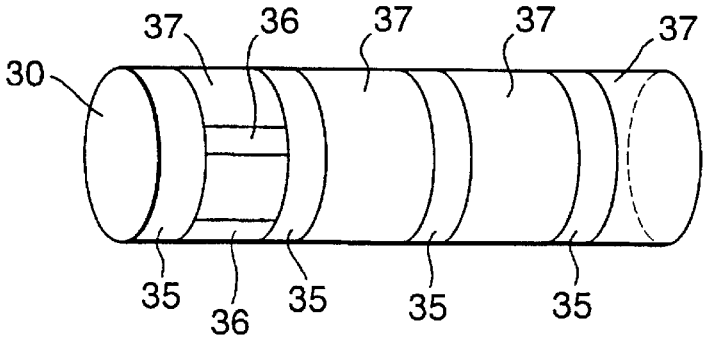

Some examples of security sheets and methods according to the invention will now be described with reference to the accompanying drawings, in which:

FIG. 1 illustrates part of a security paper web coated in accordance with a first example;

FIGS. 2A and 2B illustrate cut security sheets coated in accordance with a second example before and after printing respectively;

FIG. 3 illustrates a cut security sheet which has been coated according to a third example;

FIG. 4 illustrates schematically a coating apparatus suitable for manufacturing any of the examples shown in FIGS. 1 to 3; and, FIG. 5 is a schematic side view of a coating roller.

DETAILED DESCRIPTION OF THE INVENTION

The security paper web which is partially shown in FIG. 1 comprises a security paper substrate 1 which has been manufactured in a conventional manner using a papermaking process e.g. mould made or Fourdrinier process to develop watermarks 2. Where a windowed thread is incorporated the watermark would be normally manufactured by a mould made process. The watermarked security paper is then passed through a coater of the form schematically shown in FIG. 4 which lays down three coating stripes 3–5 on the paper web. As can be seen, the coating stripes 3–5 define uncoated bands 6,7 respectively within which the watermarks 2 lie. Following the coating step, the web is printed in a conventional manner depending upon the security documents which are to be produced and finally the web is cut into separate security documents. Dashed lines 8,9 in FIG. 1 illustrate the location of the cuts. Of course, the cutting step could be carried out before the printing step if desired.

FIG. 2A illustrates a second example, in this case of a cut security sheet prior to printing, the sheet incorporating a windowed security thread 10 and being provided with coatings 11,12 which define an uncoated region 13 registered with the security thread 10.

FIG. 2B illustrates the sheet of FIG. 2A following the application of print. The printing process may be any conventional process such as gravure, intaglio, offset letterpress and can involve printing a wide variety of inks such as colour changing inks, metallic, pearlescent inks, luminescent and the like. A variety of security features and other information could be printed such as latent images, guilloches etc. A further possibility is the printing of a photoimage, particularly in the case of identity cards. Furthermore, at least some of the printing may extend over the boundary between the coated and uncoated portions. This is illustrated at 14 in FIG. 2B where printing extends from the coated region 11 into the uncoated region 13. This helps to disguise the presence of the coating.

The presence of a coating can also be disguised by providing the edge of the coating regions 11,12 in a wavy or other non-rectilinear form (not shown).

FIG. 3 illustrates a third example in which narrower coating stripes 20–23 are laid down leaving uncoated regions 24–27 respectively. The uncoated region 27 is registered with the security thread 10. FIG. 3 also illustrates a further modification in which the stripe 20 is laid down in a discontinuous manner so as to define coated sections 28 and uncoated sections 29.

FIG. 4 illustrates schematically a typical coating apparatus comprising a coating roller 30 immersed in a bath 31 of coating material and a pressure roller 32 which defines a nip 33 with the coating roller 30 through which a web 34 of security paper is fed.

FIG. 5 illustrates a typical form for the coating roller 30. This corresponds to the roller which would be needed to create the coated sheet of FIG. 3. In this case, the roller 30 is provided with hydrophobic strips 35 to which the coating material will not adhere and also hydrophilic regions 36. As the coating roller 30 rotates, the non-hydrophilically coated portions 37 of the roller will pick up coating material and this will be transferred onto the underside of the web 34 to create the coated regions 20–23.

Following the coating step, the web is passed to a printing system for printing the required information to complete the security document and finally the printed web is fed to a cutting system for cutting into separate sheets.

There are a variety of alternatives for constructing the roller of FIG. 5. These include:

i) Annular etching, grooving or engraving the coating roller to achieve a differential take up of coating—in this case the etched, grooved or engraved annulus picks up an insignificant amount of coating in comparison with the smooth areas of the coating head.

ii) Use of narrow width airknives on the coating roller surface to clear an annular ring coating from the roller as it rotates in a continuous banded manner.

iii) Use of narrow width doctor blades on the coating roller surface to clear an annular ring coating from the roller as it rotates in a continuous banded manner.

iv) A raised annular strip is attached to the coating roller and this is used to locally hold base paper clear of the roller surface—areas held clear of the roller are thereby shielded from the application of coating leaving a coating free stripe in the otherwise coated paper.

The coating may have any conventional form and is typically formulated using an aqueous suspension of one or more fillers and an elastomeric single binder or co-binder—the fillers typically comprising of 60 to 85% of the total weight of the coating when the paper or film is dried—other additives may also be incorporated to improve the print performance, appearance, security, subsequent processability of the paper. Other additives may also be incorporated to provide particular features in the printed finished product and these may include the application of phosphors, fluorescents, chemically reactive or magnetic materials.

Typically, coatings thicknesses with a dry weight of between 10 to 20 gsm would be applied but the invention could also be used for higher and lower coating weights.

What is claimed is:

1. A security sheet comprising:

a substrate made of paper;

a viewable security feature on or in the substrate; and a print receptive coating on the substrate, the coating being oriented laterally relative to the security feature so that the coating is not applied over or under the security feature and so that the security feature is viewable from the same side of the substrate as the coating, wherein the security feature is chosen from the group comprising watermarks, security threads and banded security features.

2. A sheet according to claim 1, wherein the security feature comprises a windowed thread.

3. A sheet according to claim 1, wherein the coating comprises a number of stripes laterally spaced apart.

4. A sheet according to claim 3, wherein the stripes are rectilinear.

5. A sheet according to claim 3, wherein one or more of the stripes is discontinuous.

6. A method of manufacturing a security sheet, the method comprising providing a substrate on or in which is provided a security feature; and providing a print receptive coating on the substrate in lateral orientation with the security feature so that the coating is not applied over or under the security feature and so that the security feature is viewable from the same side of the substrate as the coating, wherein the security feature is chosen from the group comprising watermarks, security threads and banded security features.

7. A method according to claim 6, wherein the coating is provided by passing the substrate under/over a coating roller; and selectively supplying coating materials to the roller whereby the coating is provided on the substrate in such a way as not to overlap the security feature.

8. A method according to claim 7, wherein the coating roller has a surface relief, for example being etched, grooved or engraved, to achieve a differential take-up of the coating material.

9. A method according to claim 7, wherein the coating roller is selectively provided with a hydrophilic coating in those areas corresponding to areas on the coating roller which are not to receive the coating material.

10. A method according to claim 7, wherein one or more blocking members such as airknives or doctor blades are provided in association with the coating roller surface to clear an annular ring of coating from the surface is it rotates.

11. A method according to claim 7, wherein a raised annular strip is attached to the coating roller locally to hold the substrate clear of the coating roller surface.

12. A method according to claim 6, wherein the substrate is coated in an intermittent or pulsed manner so as to produce one or more discontinuous coating strips.

13. A method according to claim 6, wherein the coating is provided in a non-rectilinear form, for example by oscillating the coat-free stripe(s).

14. A method according to claim 6, wherein the security feature is provided on or in the substrate prior to providing the coating.

15. A method according to claim 6, for manufacturing a security sheet including a viewable security feature on or in a substrate; and a print receptive coating on the substrate, the coating being oriented laterally relative to the security feature so that it does not overlap the security feature and so that the security feature is viewable from the same side of the substrate as the coating wherein the security feature is chosen from the group comprising watermarks, security threads and banded security features such as fibres or planchettes.

16. A security document comprising a security sheet according to claim 1, the sheet carrying printing.

17. A security document manufactured according to claim 6, the sheet carrying printing.

18. A security document according to claim 16, wherein the printing extends over both coated and uncoated portions of the substrate.

19. A security document according to claim 18, wherein the document comprises a banknote or brand protection product.

20. A security document manufactured according to claim 17, wherein the printing extends over both coated and uncoated portions of the substrate.

21. A security document manufactured according to claim 20, wherein the document comprises a banknote or brand protection product.

22. A sheet according to claim 1, wherein the banded security features include at least one of fibers and planchettes.

23. A method according to claim 6, wherein the banded security features include at least one of fibers and planchettes.

* * * * *